United States Patent [19]

Abbe

[11] 4,305,565

[45] Dec. 15, 1981

[54] VARIABLE POSITION RAM LOCK FOR BLOWOUT PREVENTERS

[75] Inventor: Robert E. Abbe, Houston, Tex.

[73] Assignee: Hydril Company, Los Angeles, Calif.

[21] Appl. No.: 138,096

[22] Filed: Apr. 7, 1980

[51] Int. Cl.[3] ..... E21B 33/12

[52] U.S. Cl. ..... 251/1 A; 92/24; 92/27

[58] Field of Search ..... 251/1 A, 1 R; 92/23, 92/24, 27, 78, 25

[56] References Cited

U.S. PATENT DOCUMENTS

| | | | |
|---|---|---|---|
| Re. 27,294 | 2/1972 | Fredd | 92/26 |
| 3,050,943 | 8/1962 | Thorel et al. | 92/23 |
| 3,203,513 | 8/1965 | Allen | 92/28 |
| 3,272,087 | 9/1966 | Culver | 92/24 |
| 3,420,144 | 1/1969 | Berry | 92/24 |
| 3,429,233 | 2/1969 | Wright | 92/24 |
| 3,470,793 | 10/1969 | Hanchen | 92/28 |
| 3,498,182 | 3/1970 | Sheffer et al. | 92/24 |
| 3,511,048 | 5/1970 | Nemetz | 92/24 |
| 3,561,526 | 2/1971 | Williams, Jr. et al. | 251/1A |
| 3,918,346 | 11/1975 | Ziegler | 92/28 |
| 3,941,141 | 3/1976 | Robert | 251/1 A |
| 3,983,792 | 10/1976 | Furtner | 92/24 |

FOREIGN PATENT DOCUMENTS

| | | | |
|---|---|---|---|
| 2459610 | 7/1975 | Fed. Rep. of Germany | 92/23 |
| 163740 | 8/1964 | U.S.S.R. | 92/28 |
| 262355 | 5/1970 | U.S.S.R. | 92/28 |

*Primary Examiner*—H. Jay Spiegel

*Attorney, Agent, or Firm*—Pravel, Gambrell, Hewitt, Kirk, Kimball & Dodge

[57] ABSTRACT

A new and improved ram lock and blowout preventer are provided for locking a blowout preventer ram in any of a number of variable, adjustable sealing positions in a bore in the preventer. A ram carrier is mounted in a housing to move the ram to and from the sealing positions. The housing is provided with a tapered inner surface which selectively engages locking wedge members mounted with the ram carrier. A locking cone mounted with the ram carrier responds to fluid pressure during movement of the ram carrier to move the locking wedges into engagement with the tapered inner surface for locking purposes.

50 Claims, 9 Drawing Figures

VARIABLE POSITION RAM LOCK FOR BLOWOUT PREVENTERS

FIELD OF INVENTION

The present invention relates to locks for blowout preventer rams.

DESCRIPTION OF PRIOR ART

In ram blowout preventers, each closure of the ram causes a certain amount of wear of the ram sealing elements which move into the borehole of the preventer for sealing contact with a pipe or other object, such as another ram. During succeeding closures of the rams, the effectiveness of the seal was reduced when the ram was locked in sealing position due to such wear.

Certain prior art blowout preventer ram locks, such as in U.S. Pat. Nos. 3,242,826; 3,941,141 and Re. 27,294, used snap rings or collets mounted with a ram piston for locking. When the piston reached a predetermined locking position defined by a groove in the ram piston cylinder, the snap ring moved into the groove to lock the ram and piston in place. However, with this structure, only one locking position of the ram, as defined by the relative position of the snap ring and groove, was obtained. Change of the locking position to compensate for sealing element wear required adjustment of the relative positions of the locking elements, requiring undesirable disassembly of the blowout preventer cylinders for such adjustment to be made.

Other blowout preventer ram locks, such as in U.S. Pat. No. 3,208,357, used a tapered locking pin which moved into locking position behind the ram piston once the ram had been moved into sealing position. However, extra hydraulic operating and control lines, separate and distinct from those for causing ram piston movement, were required, increasing the complexity of the control system for those types of ram locks.

In U.S. Pat. Nos. 4,052,995 and 4,076,208, assigned to the assignee of the present application, these shortcomings have been for the most part overcome. However, these locks required close machining tolerances on several parts in order to keep ram backlash to a tolerable level when the ram was in the locked position. These close machinery tolerances, as well as the screw threads involved, required substantial manufacturing costs. U.S. Pat. Nos. 3,036,807 and 3,871,613 involved other types of locking mechanisms for blowout preventer rams.

U.S. Pat. Nos. 3,203,513 and 3,470,793 utilized wedge shaped members for locking cylinders. However, in U.S. Pat. No. 3,203,513 a spring member was used to cause locking force in the absence of fluid pressure on a piston. The pressure forces involved in well blowout preventers, however, would require an expensive, high strength spring for use with this technique. In U.S. Pat. No. 3,470,793, locking action relied on frictional engagement between a cylindrical liner member and a cylinder wall. This type of locking action would be of questionable effectiveness in blowout preventers, due to the forces involved.

SUMMARY OF INVENTION

Briefly, the present invention provides a new and improved ram lock and blowout preventer for locking a blowout preventer ram in a sealing position in a bore of the preventer. The ram may be locked at adjustable, variable positions over a locking range to compensate for seal wear during use. The ram may be a blind ram for sealing the bore with another ram, with or without tubing or some other object in the bore, or alternatively a shear ram for shearing the object and thereafter sealing the bore.

In a ram lock according to the present invention, a ram carrier moves the ram to and from a sealing position in the bore of the preventer in response to fluid pressure. The ram carrier is mounted in a housing which receives the fluid pressure for moving the ram carrier and ram. The housing also has a tapered inner surface.

Locking wedges are mounted with the ram carrier and move with the ram carrier. The locking wedges are moved into engagement with the tapered surface of the housing to lock the ram by means of a locking cone which moves with respect to the ram carrier. With the lock structure of the present invention, forces from pressure in the bore of the preventer, or elsewhere, exerted to move the ram and ram carrier away from the sealing position only serve to drive the locking wedges, locking cone and housing tapered surface into firmer locking engagement. Unlocking structure is provided in the ram lock of the provision to release locking engagement when it is no longer necessary or desirable to seal the bore of the blowout preventer.

DESCRIPTION OF PREFERRED EMBODIMENT

Figure 1:
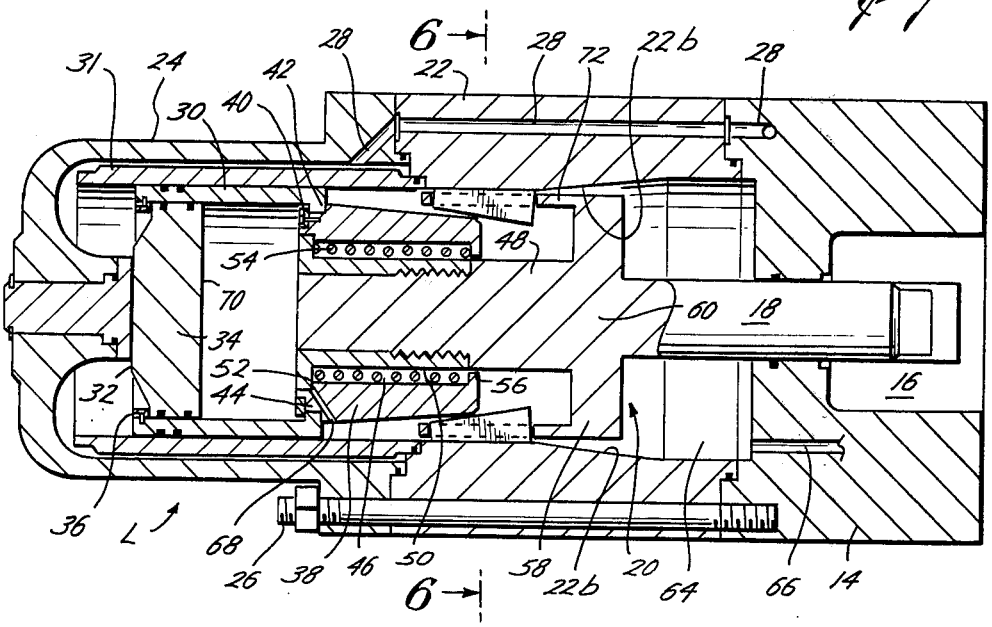
FIGS. 1, 1A, 2, 3, 4, 5 and 5A are vertical cross-sectional views of a blowout preventer ram lock according to the present invention in various operating positions.

In the drawings, the letter B (FIG. 7) refers generally to a blowout preventer of the present invention which is formed with a pair of rams R, each of which may be locked into place by a locking apparatus L of the present invention automatically and at adjustable closed positions for sealing contact with each other, or with a well pipe or similar object. The blowout preventer B is typically mounted in a stack of blowout preventers or in a string of well casing or pipe.

Figure 7:
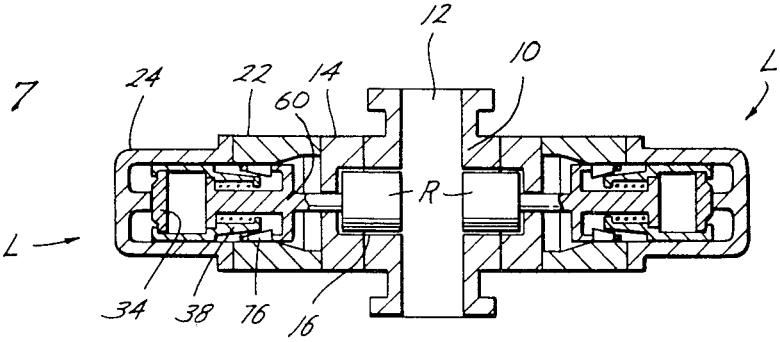
FIG. 7 is a vertical sectional view of a blowout preventer according to the present invention.

As is conventional, the rams R are disposed in a conventional blowout preventer body or housing 10 having a longitudinal well bore 12 formed therethrough, through which well pipe or other objects such as well tools may pass in normal operations conducted with the blowout preventer B in an open or retracted position (FIG. 7). In the open position, the rams R are mounted in conventional recesses in the body 10 adjacent the bore 12. The rams R move in response to a motive or power means from their respective recesses into an extended or closed position in the bore 12 for sealing contact of conventional sealing elements with a well pipe, well tool or another ram. The sealing elements of the ram are conventional and are carried by the ram R. Since the sealing elements and ram blocks are conventional, they are not shown in the drawings in order to more clearly show other structure.

The rams R may be any of several types of blowout preventer rams. For example, the rams R may be of the type known as a "blind" ram for sealing against another "blind" ram of similar structure; the type wherein the sealing inner portions of the rams are shaped for sealing about a pipe or well tool in the bore, as well as with one another on each side of the pipe or well tool; or the shear-seal ram type for shearing tubing or objects in the bore 12 in conjunction with a similar shear-seal ram and thereafter sealing the bore 12 of the preventer B against well pressure.

A conventional head or bonnet 14 (FIGS. 1 & 7) is connected to each side of the body or housing 10 and each of such heads or bonnets has a conventional recess 16 aligned with the receses in the housing or body 10 so that the rams R may be received in such recesses when they are in the extracted or open position (FIG. 7). A piston rod 18 (FIG. 1) for each of the rams R extends through suitable sealing structure to the opening 16 of the head or bonnet 14 associated therewith. Each piston rod 18 extends to a ram carrier 20 which is disposed in a piston cylinder 22. O-rings or other suitable seals are provided between the housing 22 and the bonnet 14 for fluid sealing purposes. The ram carrier 20 moves in response to motive means within the cylinder 22 in a manner to be set forth.

A cylinder or head cap 24 is mounted to the housing 22 with O-rings or other suitable seals provided therebetween for fluid sealing. The housing 22 and the cylinder 24 are mounted to the bonnet 14 by means of bolts 26 or other suitable fastening means.

For purposes of illustration in the preferred embodiment, the motive means includes a suitable fluid inlet line 28 formed extending through the bonnet 14, housing 22 and cylinder 24 for introducing air, hydraulic fluid or other operating fluid pressure into the cylinder 24 in the interior of an annular piston or sleeve 30 which slides in the housing 22 with suitable sealing structure therebetween. A fluid separator sleeve 31 is fixedly mounted with the housing 22 and extends rearwardly into the interior of cylinder 24 to receive the piston 30. The piston 30 moves inwardly and outwardly in the sleeve 31 and housing 22 in response to receipt of fluid pressure, for reasons to be set forth. Suitable fluid seals are provided with sleeve 31, as indicated. Operating fluid pressure in the piston 30 acts against an outer surface 32 of a floating piston 34 mounted within the piston 30 for relative movement therein. Suitable fluid seals are provided between the floating piston 34 and the piston 30 as indicated.

An annular retaining ring 36 is mounted at an outer end of the piston 30 to retain the floating piston 34 in the piston 30 and to limit rearward movement of the floating piston 34 to an outermost position (FIGS. 1, 3, 4, 5 and 5A) with respect to the piston 30.

A locking cone 38 is mounted at an inner end of the piston 30 by means of a retaining flange 40 so that a limited amount of radial, but little longitudinal, motion occurs between the locking cone 38 and the piston 30. The retaining flange 40 is mounted by suitable attaching structure to engage an inwardly extending lip 42 of the piston 30 in a groove formed by the retaining flange 40 and a reduced diameter rear portion 44 of locking cone 38. Alternatively, a loose thread with an anti-rotation locking screw may be substituted for the retaining flange 40.

The locking cone has a tapered outer conical surface **38*a* (FIG. 5) formed thereon extending rearwardly from an chamfer 38*b*. The locking cone 38 also has a hollow interior portion 46 through which a rear portion 48 of the ram carrier 20 passes. A shouldered nut 50 (FIG. 2) having a shoulder 52 is threadedly or otherwise connected to the rear portion 48 of the ram carrier 20 so that a compression spring 54 (FIG. 1) or other suitable resilient means may be mounted between the shoulder 52 and an inner lip 56 of the locking cone 38. The shoulder 52 is also adapted to fit in and engage a recessed rear pocket of the locking cone 38**, for reasons to be set forth.

The ram carrier 20 has a disk member 58 extending outwardly from an intermediate portion 60 of the piston rod 18. Opening and unlocking fluid pressure is provided into a chamber 64 in the housing 22 through a suitable conduit such as the one shown at 66 to act on the inner end of the piston 30. Further, an unlocking port 68 is formed in the locking cone 38 (FIG. 4) to permit unlocking fluid pressure entering chamber 64 to also enter the interior of the sleeve 30 and act on an inner surface 70 of the floating piston 34, to assist the piston 30 in unlocking the lock L.

A skirt member 72 (FIG. 1) is formed on the ram carrier 20 extending rearwardly from the disk member 58 into the interior portion 64 of the housing 22. A plurality of slots or pockets 74 are formed in the sleeve member 72 about its periphery (FIG. 6) forming a cage member on sleeve 72 to receive a suitable number of locking wedge members 76 therein. The locking wedge members 76 have tapered or conical inner surfaces **76*a* matching in slope the surfaces 38*a* of the locking cone 38. The locking wedge members 76 further have retaining flanges 76*b* (FIG. 6) formed thereon for retaining them in position in the cage member on sleeve 72. An annular rim or outer lip member 77 (FIG. 5) is formed about the circumference of the skirt member 72 rearwardly from the pockets 74 in order to also retain the locking wedges 76 within the cage of skirt member 72. The locking wedges 76 thus travel with the ram carrier 20 during movement of the ram carrier 20. The locking wedges 76 are further movably mounted within their respective pockets 74 to engage, along a tapered or conical outer surface 76*b*, a cylindrical surface 22*a* (FIG. 2) formed at rear portions in the interior of the housing 22 and an outwardly tapered conical surface 22*b* (FIG. 2) within the housing 22, depending upon the relative position of the ram carrier 20 with respect to the housing 22. The taper angle on the surface 38*a* and 76*a* is less than the equivalent friction angle (approximately six degrees) between these surfaces so that inward radial forces on the wedges 76 do not cause longitudinal movement of the locking cone 38**.

In the operation of the present invention, the rams R are normally in the fully retracted position (FIGS. 1 and 7) during well operations and the shoulder 52 on the piston rod 48 is in contact with the locking cone 38 (FIG. 1). The locking wedges 76 in the case of sleeve 72 are in contact with the cylindrical surface of the cylinder 22 and the chamfer **38*b* of the locking cone 38, as well as the outer lip member 77 of the skirt member 72. The floating piston 34 is at the outermost position within the piston 30, bearing against the retaining ring 36**.

During an extension or closing stroke to move the rams R inwardly into the bore 12, fluid pressure from the conduit 28 of the motive means is applied against the annular piston 30 and the surface 32 of the floating piston 34, causing the floating piston to move within the piston 30 until contact is made with the rear portion 48 of the ram carrier 20 and with the threaded nut 52. Thereafter, the annular piston 30, floating piston 34, ram carrier 20 and the locking wedges 76 move together inwardly through the cylinder 22.

Figure 1A:
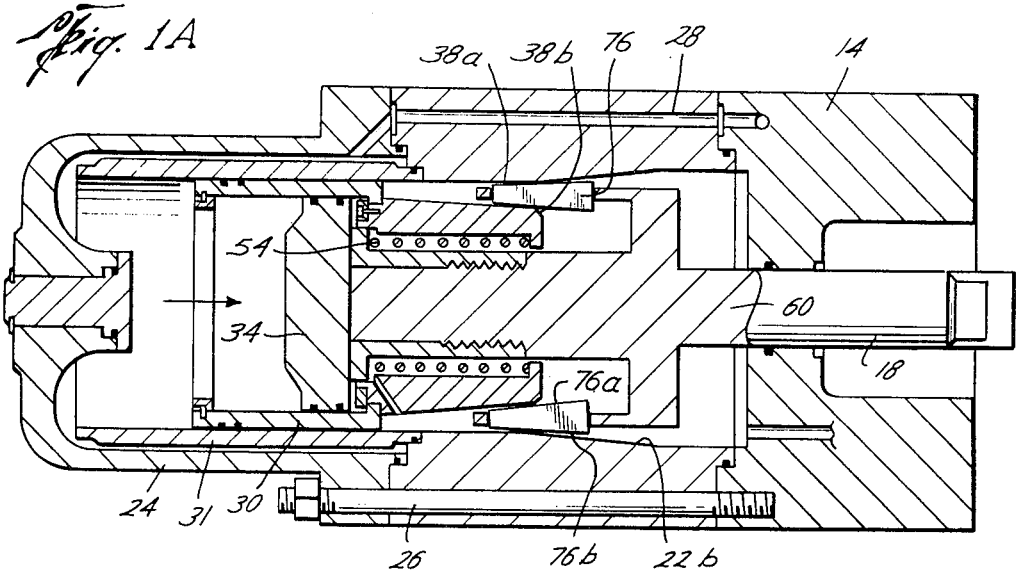
Figure 5A:
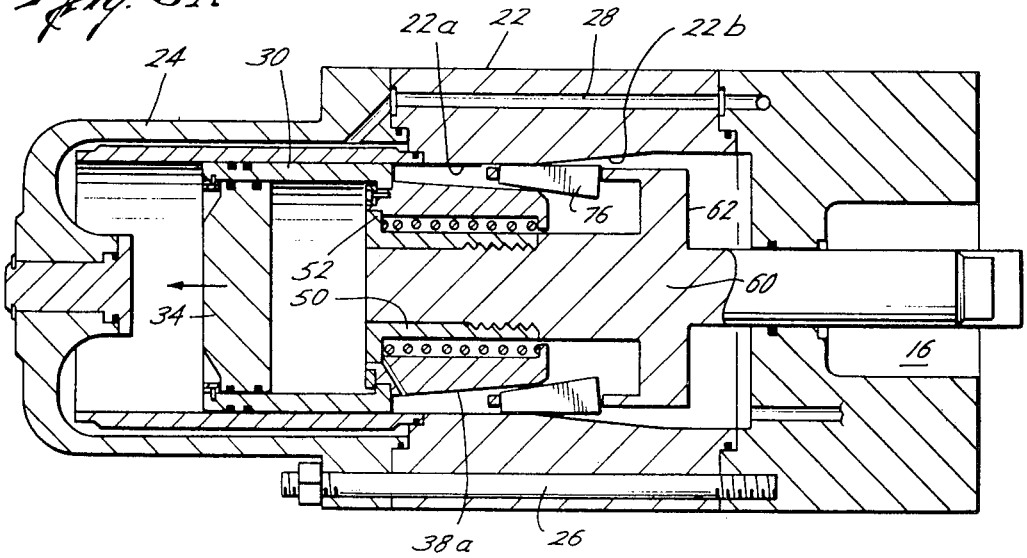

At the time the approximate centers (FIG. 1A) of locking wedges 76 reach the transition between the cylindrical surface 22*a* and the conical surface 22*b* within the housing 22, the locking wedges 76 are in the inwardly tilted portion shown in FIG. 1A. Continued presence of fluid pressure on the piston 30 causes the piston 30 and the locking cone 38 to continue inward movement within the skirt member 72, thereby camming or pivoting the locking wedges 76 outwardly by the chamfer 38*b* moving along the surfaces 76*a*. The wedge members 76 thus move outward to contact the surface 22*b* and form a position of wedged, locking engagement between the housing 22 and locking cone 38, to prevent rearward movement of ram carrier 20 and ram R with respect to the bore 12 of the blowout preventer B once an initial sealing position is achieved (FIG. 2) with the lock mechanism L of the present invention in an initial locking position. In the initial locking position, the lock mechanism L locks the rams R in a sealing position for new and unworn seals on the rams R. In this locking position, fluid pressure in the interior of cylinder 24 and piston 30 may be removed. Any tendency of the piston rod 18 to move rearwardly after fluid pressure is removed causes the piston rod skirt member 72 to exert a force against the inner ends of the locking wedges 76, causing the wedges 76 to become more firmly locked between the conical surfaces 22*b* of the housing 22 and 38*a* of the locking cone 38.

Figure 2:
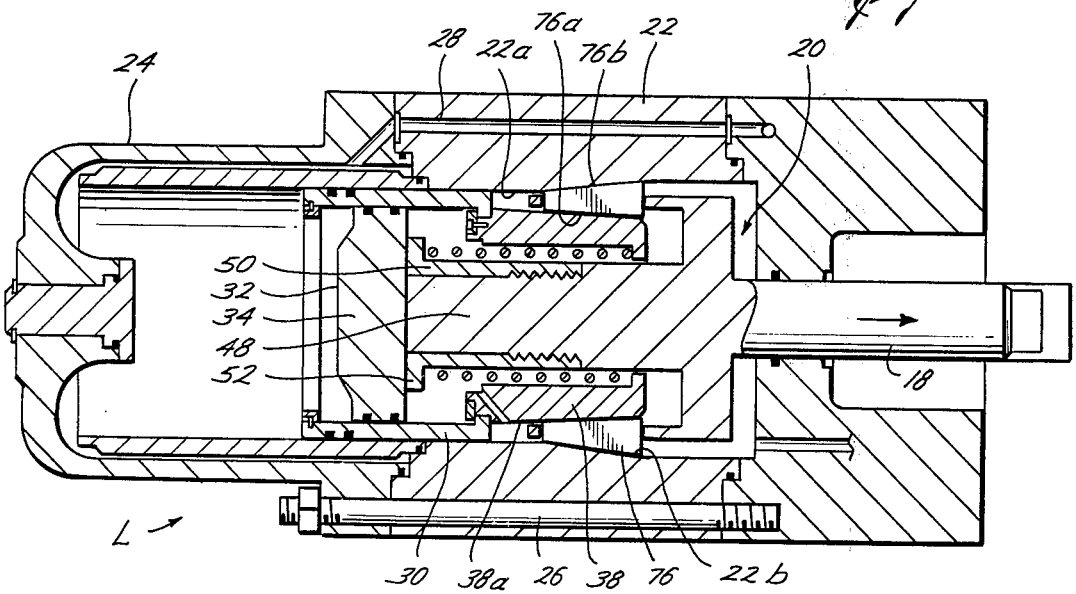

In the event it is desirable to move the rams R further inwardly from the initial locking position of FIG. 2, fluid pressure is maintained on the piston 30 and floating piston 34, causing the locking cone 38 to move the locking wedge members 76 further along the tapered surface 22*b*, while simultaneously moving the ram carrier 20 and ram R further inwardly with respect to the bore 12 of blowout preventer B. When the desired sealing position is reached, fluid pressure within cylinder 24 is released, and the locking mechanism L automatically locks the rams R in such sealing position.

Figure 3:
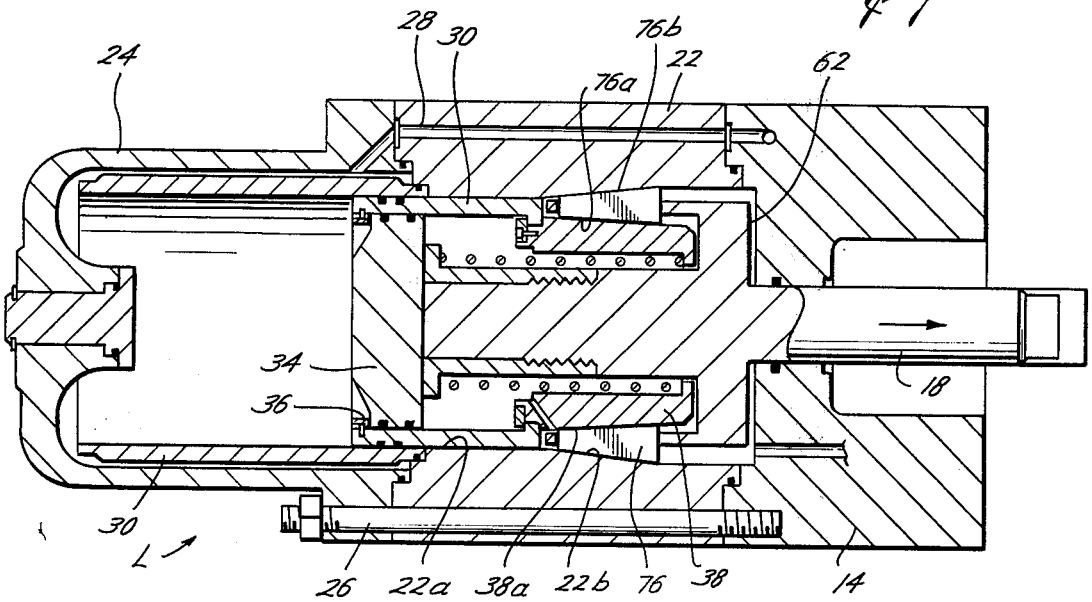
Figure 4:
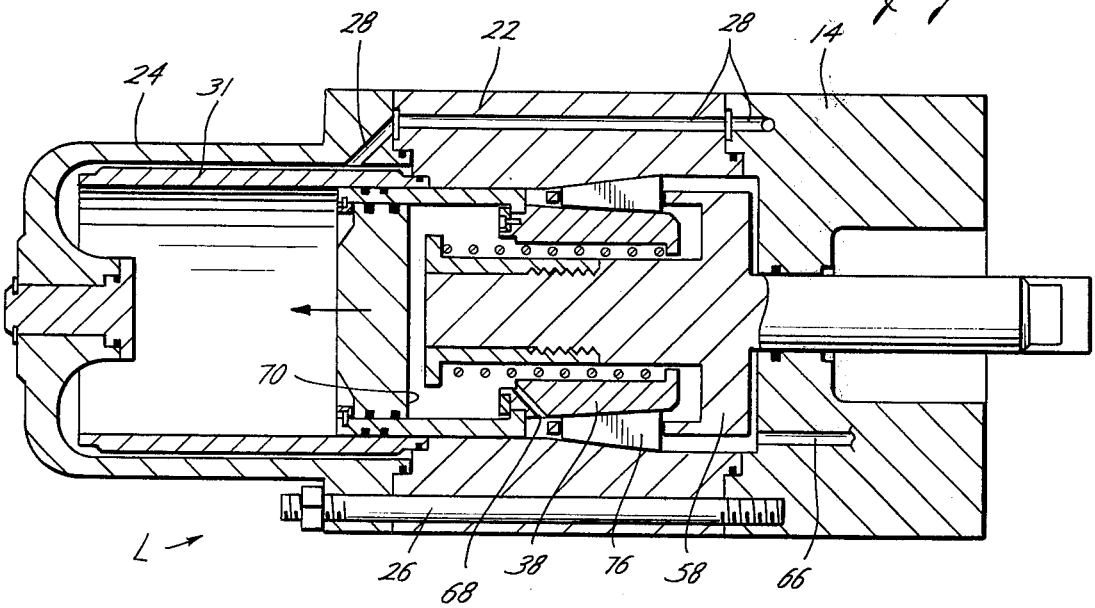

For example, as the blowout preventer B is used in continued service, the seals with the ram R tend to wear away, requiring a new and adjustable locking position to ensure adequate sealing action. With the lock L of the present invention having the tapered surfaces 22*b* and 38*a*, the wedge members 76 may be moved inwardly to an almost limitless number of locking position, depending upon the length of the tapered surface 22*b* of housing 22 and the tapered surface 38*a* of the locking cone 38. In FIG. 3, the ram carrier 20 is in an example maximum extended position with the inner surface 62 thereof in close proximity to the bonnet 14, but with the locking wedge members 76 still wedged between the surface 38*a* of locking cone 38 and surface 22*b* of housing 22, a position corresponding to a locking position which could possibly be required to lock a ram with worn seals. In this position, the piston 30 has moved to an inner limit of travel, where retaining ring 36 contacts the outer surface 32 of piston 34 which is in contact with the ram carrier 20. The locking wedges 76 in this position contact the locking cone 38 at an outer end of the tapered surface 38*a* while contact is made with the conical surface 22*b* of the housing 22 at its inner end, a situation opposite that shown in FIG. 2. The length of the locking range or stroke of the lock L and the range of locking positions within such a stroke is illustrated by the difference in positions of ram carrier 20 in FIGS. 2 and 3. The locking range may be controlled by the angles chosen for the tapered surfaces of the cone 38 and wedge members 76, as well as the taper of the surface 22*b* so that the piston rod or ram carrier 20 may be locked at a virtually limitless number of points within the locking range.

Figure 5:
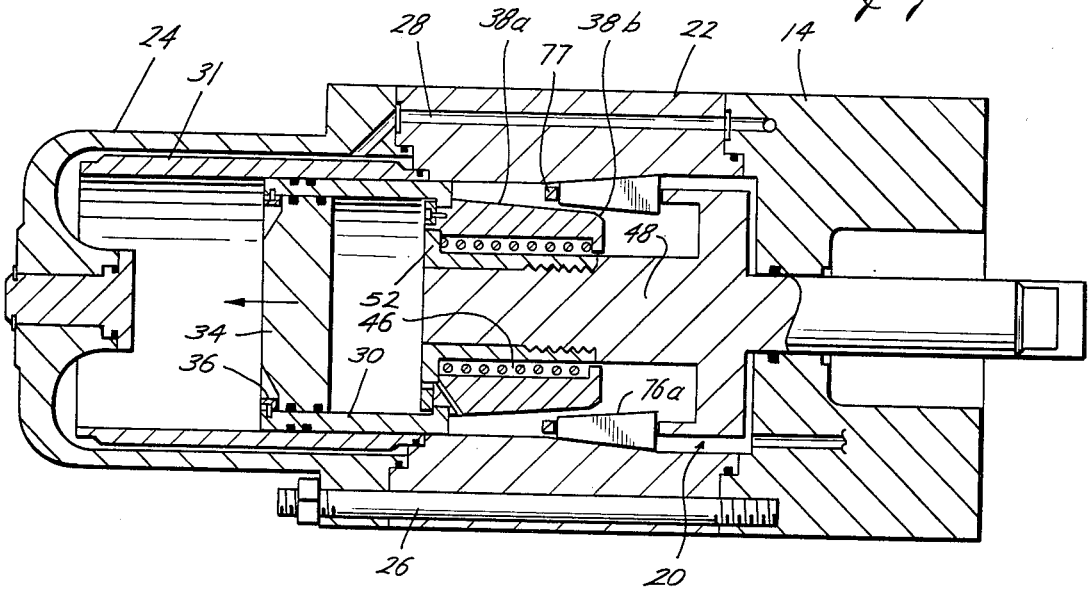
Figure 6:
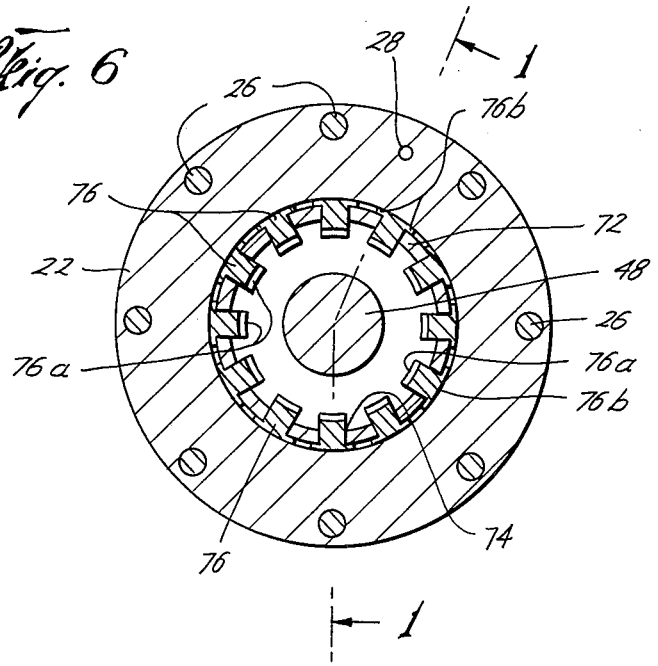
FIG. 6 is a cross-sectional view taken along the lines 6—6 of FIG. 1.

Unlocking of the ram carrier 20 (FIG. 4) automatically occurs when fluid pressure is applied when it is necessary or desirable to move the rams R rearwardly and open the bore 12 of the blowout preventer B. Such fluid pressure serves both as opening and unlocking pressure and enters through conduit 66 to the chamber 64 in the housing 22 to act on piston 30. Fluid pressure in chamber 64 also passes through the unlocking port 68 of the locking cone 38 to act on the inner surface 70 of the floating piston 34. Fluid pressure on the pistons 30 and 34 causes the piston 34 to contact the retaining ring 36. As the piston 30 moves in response to pressure and the rearward movement of the floating piston 34, the locking cone 38 is withdrawn from contact with the locking wedges 76. The locking cone 38 is withdrawn rearwardly until contact is made by the rear pocket of locking cone 38 with the shouldered nut 52 (FIG. 5). In this position, the locking cone 38 is no longer in engagement with the locking wedges 76 and the locking mechanism L is unlocked.

With the locking mechanism L thus unlocked, fluid pressure in the chamber 64 then may begin to move the ram carrier 20 rearwardly due to fluid pressure on the floating piston 34 and annular piston 30. The ram carrier 20 and the remaining portions of the locking mechanism L then continue rearward movement in the housing 22. When the locking wedges 76 reach the transition between the conical surface 22*b* and the cylindrical surface 22*a* of the housing 22, they are cammed or pivoted inwardly by the transition of surfaces to a retracted position (FIG. 5A) within the cages in skirt member 72 to slide freely along the surface 22*a* of the cylinder 22. Rearward movement continues until the ram carrier 20 comes to the original open position shown in FIG. 1.

Although not required for the locking and unlocking of the mechanism L of the present invention, the spring 54 or some other suitable resilient means is preferably included between the shouldered nut 50 and the locking cone 38 as a safety measure to prevent unusual vibration conditions from loosening the locking mechanism L when engaged. The spring 54 also helps to keep the wedge member 76 in alignment within the skirt member 72 when the piston or sleeve 30 and the ram carrier 20 are in motion.

From the foregoing it can be seen that a new and improved multiple position ram lock and lockable blowout preventer are provided which permit automatic locking at adjustable, variable positions to compensate for ram seal wear and other factors. Further, the ram lock L of the present invention automatically unlocks in the event it is desired or necessary to move the rams R out of the bore 12. Also, the requirement for precision tolerances with attendant manufacturing costs are reduced from prior art ram locks with the present invention.

The foregoing disclosure and description of the invention are illustrative and explanatory thereof and various changes in the size, shape and materials as well as in the details of the preferred embodiment may be made without departing from the spirit of the invention.

I claim:

1. In a blowout preventer, a ram lock for locking a ram of said preventer in a sealing position to seal a bore of said preventer, comprising:

(a) ram carrier means for moving said ram to and from the sealing position;

(b) housing means receiving said ram carrier means therein, said housing means further having a tapered surface formed along an inner portion thereof;

(c) locking wedge means mounted with said ram carrier means for movement therewith, said locking wedge means having a tapered surface adapted to engage said tapered surface of said housing means to lock said ram; and (d) locking cone means mounted for relative movement with respect to said ram carrier means for engaging said locking wedge means and moving said tapered surface thereof into engagement with said tapered surface of said housing means to lock said ram in the sealing position.

2. The blowout preventer of claim 1, wherein said ram comprises ram means for sealing said bore in conjunction with another ram in said blowout preventer.

3. The blowout preventer of claim 2, wherein said ram means includes shearing blade means mounted therewith for shearing an object in the bore prior to sealing.

4. The blowout preventer of claim 1, wherein said preventer includes at least a pair of rams and wherein each of said rams has a ram lock therewith, each said ram lock comprising:

(a) ram carrier means for moving said ram to and from the sealing position in response to fluid pressure;

(b) housing means receiving said ram carrier means therein and further receiving fluid pressure to move said ram carrier means, said housing means further having a tapered surface formed along an inner portion thereof;

(c) locking wedge means mounted with said ram carrier means for movement therewith, said locking wedge means having a tapered surface adapted to engage said tapered surface of said housing means to lock said ram; and (d) locking cone means mounted for relative movement with respect to said ram carrier means for engaging said locking wedge means and moving said tapered surface thereof into engagement with said tapered surface of said housing means to lock said ram in the sealing position.

5. The blowout preventer of claim 1, wherein said locking cone means comprises:

locking cone means mounted for relative movement with respect to said ram carrier means for moving said locking wedge means into engagement with said tapered surface of said housing at variable positions of said ram carrier means with respect to said housing means to lock said ram at variable sealing positions.

6. The blowout preventer of claim 1, wherein said locking cone means comprises:

locking cone means mounted for relative movement with respect to said ram carrier means for moving said tapered surface of said locking wedge means into engagement with said tapered surface of said housing at adjustable positions of said ram carrier means with respect to said housing means to lock said ram at adjustable sealing positions.

7. The blowout preventer of claim 1, further including:

means for moving said locking cone means out of engagement with said locking wedge means to unlock said ram from the sealing position.

8. The blowout preventer of claim 1, further including:

annular piston means having a surface formed thereon for receiving fluid pressure in said housing to move said ram carrier means and said ram from the sealing position.

9. The blowout preventer of claim 1, further including:

floating piston means mounted with said locking cone means for moving said ram carrier means, said locking wedge means and said locking cone means towards the bore of said preventer in response to fluid pressure in said housing.

10. The blowout preventer of claim 9, wherein said locking cone means includes a sleeve having a cylinder formed therein for receiving said floating piston means therein.

11. The blowout preventer of claim 10, wherein said floating piston means is movable in said sleeve.

12. The blowout preventer of claim 11, further including:

means for retaining said floating piston means within said sleeve.

13. The ram lock of claim 12, further including:

means for retaining said floating piston means within said piston sleeve.

14. The blowout preventer of claim 9, wherein said floating piston means has inner and outer surfaces for receiving fluid pressure to cause relative movement of said floating piston means with respect to said locking cone means.

15. The blowout preventer of claim 14, wherein said outer surface of said floating piston means comprises means receiving fluid pressure to initially move said ram carrier means inwardly towards the sealing position.

16. The blowout preventer of claim 15, wherein said locking cone means comprises means for receiving fluid pressure after said ram carrier moves the ram into the sealing position and moving said locking wedge means into locking engagement with said tapered surface of said housing means.

17. The blowout preventer of claim 14, wherein said inner surface of said floating piston means comprises means receiving fluid pressure to move said locking cone means and disengage said locking wedge means from said locking cone means.

18. The blowout preventer of claim 17, further including:

port means formed in said locking cone means for passage of fluid pressure to act on said inner surface of said floating piston means.

19. The blowout preventer of claim 1, wherein said locking cone means has a tapered outer surface for engaging said locking wedge means.

20. The blowout preventer of claim 19, wherein said tapered outer surface of said locking cone means has an angle of taper less than the equivalent friction angle between said tapered surface and said locking wedge means.

21. The blowout preventer of claim 1, further including:

resilient means mounted between said ram carrier means and said locking cone means for preventing vibrations from disengaging said locking cone means from said locking wedge means.

22. The blowout preventer of claim 1, wherein said ram carrier means includes:

(a) a piston rod adapted to receive said ram on an inner end thereof;

(b) disk member extending outwardly from an intermediate portion of said piston rod; and (c) a skirt member extending from said disk member.

23. The blowout preventer of claim 22, wherein:

(a) said locking wedge means comprises a plurality of wedge members; and (b) said skirt member has pockets formed therein for receiving said plurality of wedge members therein.

24. The blowout preventer of claim 22, wherein said skirt member comprises means engaging said locking cone means for moving said locking cone means out of engagement with said locking wedge means.

25. The blowout preventer of claim 1, wherein said locking wedge means comprises a plurality of wedge members mounted with said ram carrier means.

26. The blowout preventer of claim 1, further including:

annular piston means receiving fluid pressure to move said locking cone means and disengage said locking wedge means from said locking cone means.

27. A ram lock adapted for installation in a housing having a tapered inner surface in a blowout preventer for locking a ram of the preventer in a sealing position to a seal bore of the preventer, comprising:

(a) ram carrier means adapted for movement in the housing when installed therein;

(b) locking wedge means mounted with said ram carrier means for movement therewith, said locking wedge means having a tapered surface adapted to engage said tapered surface of said housing means to lock said ram; and (c) locking cone means mounted for relative movement with respect to said ram carrier means for engaging said locking wedge means and moving said tapered surface thereof into engagement with said tapered surface of said housing means to lock said ram in the sealing position.

28. The ram lock of claim 27, further including:

floating piston means mounted with said locking cone means.

29. The ram lock of claim 28, wherein said locking cone means includes a piston sleeve having a cylinder formed therein for receiving said floating piston means therein.

30. The ram lock of claim 29, wherein said floating piston means is movable in said piston sleeve.

31. The ram lock of claim 30, wherein said floating piston means has inner and outer surfaces for receiving fluid pressure when installed to cause relative movement of said floating piston means with respect to said locking cone means.

32. The ram lock of claim 31, wherein said outer surface of said floating piston means comprises means receiving fluid pressure to initially move said ram carrier means inwardly towards the sealing position when installed.

33. The ram lock of claim 31, wherein said locking cone means comprises means for receiving fluid pressure and moving said locking wedge means into locking engagement with the tapered surface of the housing means when installed therein.

34. The ram lock of claim 31, wherein said inner surface of said floating piston means comprises means receiving fluid pressure to move said locking cone means and disengage said locking wedges from said locking cone means.

35. The ram lock of claim 34, further including:

port means formed in said locking cone means for passage of fluid pressure to act on said inner surface of said floating piston means.

36. The ram lock of claim 27, wherein said locking cone means has a tapered outer surface for engaging said locking wedge means.

37. The ram lock of claim 27, further including:

said tapered outer surface of said locking cone means having an angle of taper less than the equivalent friction angle between said tapered surface and said locking wedge means.

38. The ram lock of claim 27, wherein said ram carrier means includes:

(a) a piston rod adapted to receive said ram on an inner end thereof;

(b) disk member extending outwardly from an intermediate portion of said piston rod; and (c) a skirt member extending from said disk member.

39. The ram lock of claim 38, wherein:

(a) said locking wedge means comprises a plurality of wedge members; and (b) said skirt member has pockets formed therein for receiving said plurality of wedge members therein.

40. The ram lock of claim 38, wherein said skirt member comprises means engaging said locking cone means for moving said locking cone means out of engagement with said locking wedge means.

41. The ram lock of claim 27, wherein said locking wedge means comprises a plurality of wedge members mounted with said ram carrier means.

42. The ram lock of claim 27, wherein said piston sleeve means comprises means receiving fluid pressure to move said locking cone means and disengage said locking wedge means from said locking cone means.

43. A method of locking a blowout preventer ram in a sealing position in a bore of the preventer, with the preventer including a housing having a tapered inner surface, comprising the steps of:

(a) moving a ram carrier in the housing inwardly towards the bore of the blowout preventer until the ram is in the sealing position in the bore;

(b) simultaneously moving a locking cone and locking wedge members, each having a tapered surface adapted to engage the tapered inner surface of the housing inwardly with the ram carrier until the locking wedge members reach the tapered inner surface of the housing;

(c) thereafter pivoting the locking wedges to move the tapered surfaces thereof into engagement with the tapered inner surface of the housing; and (d) locking the locking wedges between the locking cone and the tapered inner housing to lock the ram carrier and the ram against rearward movement from the sealing position.

44. The method of claim 43, wherein the sealing position of the ram is variable according to wear on a seal in the ram and wherein said step of moving comprises the step of:

moving a ram carrier in the housing inwardly towards the bore of the blowout preventer until the ram is in the variable sealing position in the bore.

45. A ram carrier adapted to move, when installed, in a blowout preventer housing which has an inner portion with a tapered surface along part of its length, and move a ram to and from multiple sealing positions in a bore of the blowout preventer, comprising:

(a) a piston rod adapted to receive the ram on an inner end thereof:

(b) a disk member extending outwardly from an intermediate portion of said piston rod;

(c) a skirt member extending from said disk member;

(d) said skirt member having a plurality of pockets formed therein;

(e) locking wedge members mounted in said pockets and having surfaces adapted to engage the inner portion of the blowout preventer housing during movement through the housing with said skirt member;

(f) said locking wedge members pivoting for movement to form tapered surfaces to engage the tapered surface of the inner portion of the housing when the ram is in the sealing positions; and (g) a locking cone assembly mounted on said piston rod for relative movement therewith to contact said locking wedge members and move said locking wedge members to engage the tapered inner surface of the blowout preventer housing to thereby lock said piston rod in the sealing positions.

46. A locking cone assembly adapted to be mounted for relative movement with a ram carrier in a housing having a tapered inner surface to contact a locking wedge and move the wedge into engagement with the tapered inner surface of the housing to lock a ram in sealing position in a bore of a blowout preventer when installed, comprising:

(a) a body member having a tapered camming surface movable with respect to the ram carrier when installed to contact the locking wedge and move same into engagement with the tapered inner surface of the housing;

(b) floating piston means for moving said body member so that said tapered camming surface may move into contact with the locking wedge and move the wedge into engagement with the tapered inner surface of the housing; and (c) said body member having a piston sleeve formed extending from said camming surface for receipt of said floating piston means.

47. The locking cone assembly of claim 46, further including:

means for retaining said floating piston means within said piston sleeve.

48. The locking cone assembly of claim 46, further including:

said floating piston means having inner and outer surfaces for receiving fluid pressure when installed to cause relative movement of said floating piston means with respect to said body member.

49. The locking cone assembly of claim 46, further including:

port means formed in said body member for passage of fluid pressure to act on said inner surface of said floating piston means.

50. The locking cone assembly of claim 46, wherein said tapered camming surface has a chamfer formed at an inner end thereof.

* * * * *